United States Patent [19]

Frey

[11] 4,344,475

[45] Aug. 17, 1982

[54] OFFICE PARTITION INTERCONNECTOR ASSEMBLY

[76] Inventor: Fred J. Frey, 2307 Foxdale Ter., Long Beach, Michigan City, Ind. 46360

[21] Appl. No.: 146,739

[22] Filed: May 5, 1980

Related U.S. Application Data

[63] Continuation of Ser. No. 935,041, Aug. 18, 1978, abandoned, which is a continuation of Ser. No. 829,386, Aug. 31, 1977, abandoned, which is a continuation of Ser. No. 673,492, Apr. 5, 1976, abandoned.

[51] Int. Cl.[3] ..... A47G 5/00; E05D 7/00

[52] U.S. Cl. ..... 160/135; 16/225; 160/231 A; 160/351

[58] Field of Search ..... 160/135, 183, 229 R, 160/231 R, 231 A, 232, 351; 52/36, 236, 282; 211/189, 199; 16/150

[56] References Cited

U.S. PATENT DOCUMENTS

| | | | |
|---|---|---|---|
| 2,882,564 | 4/1959 | Couse et al. | 52/282 |
| 3,063,105 | 11/1962 | Hollands | 160/229 R |
| 3,324,930 | 6/1967 | Colombo | 160/231 R |
| 3,441,975 | 5/1969 | Shepherd | 160/231 A X |
| 3,592,289 | 7/1971 | Aysta et al. | 160/135 X |
| 3,695,330 | 10/1972 | Hasbrouck | 160/135 |
| 3,781,944 | 1/1974 | Gianardi | 160/135 X |
| 3,788,378 | 1/1974 | Sobel | 160/135 |
| 3,871,153 | 3/1975 | Birum | 52/239 |
| 3,871,435 | 3/1975 | Lopatka | 160/135 |

*Primary Examiner*—Rodney H. Bonck

[57] ABSTRACT

Office partition interconnector assembly comprising a separate and independent generally rigid support member fixedly mountable on a lateral end of a partition panel and having edge retaining channel means, e.g. projecting outwardly therefrom and containing an outwardly directed communicating slot, and conjointly therewith a generally resilient flexible web having an enlarged edge at one side thereof for operative removable insertion in the support member channel means and also having attachment means, such as another such enlarged edge, at the other side thereof for removably attaching the web to another partition panel, thereby to provide an interposed self-contained modular type flexible connection between the panels adjustably at any selective angular relation of the panels to form an office partition, the support member and flexible web preferably being bilateral for interconnecting two partition panels in end to end relation or a plurality of such panels in radially disposed adjacency about a common center point within the confines of the corresponding interconnectors thereat, whereby to provide an almost infinite variety of shapes and layouts for rooms accomplished by so joining office partition panels together in an interchangeable modular manner permitting their ready assembly, disassembly and reassembly as desired.

38 Claims, 7 Drawing Figures

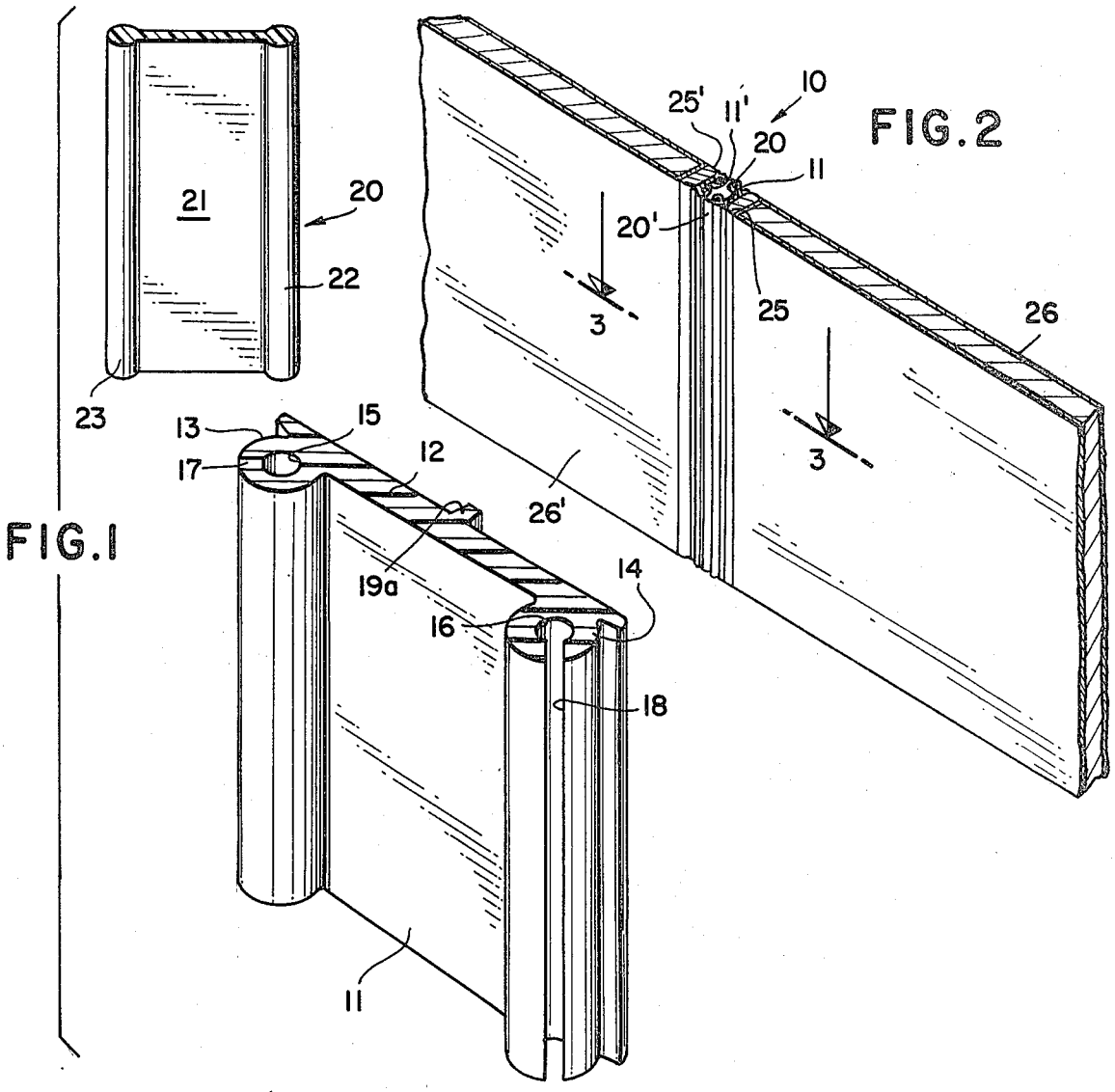
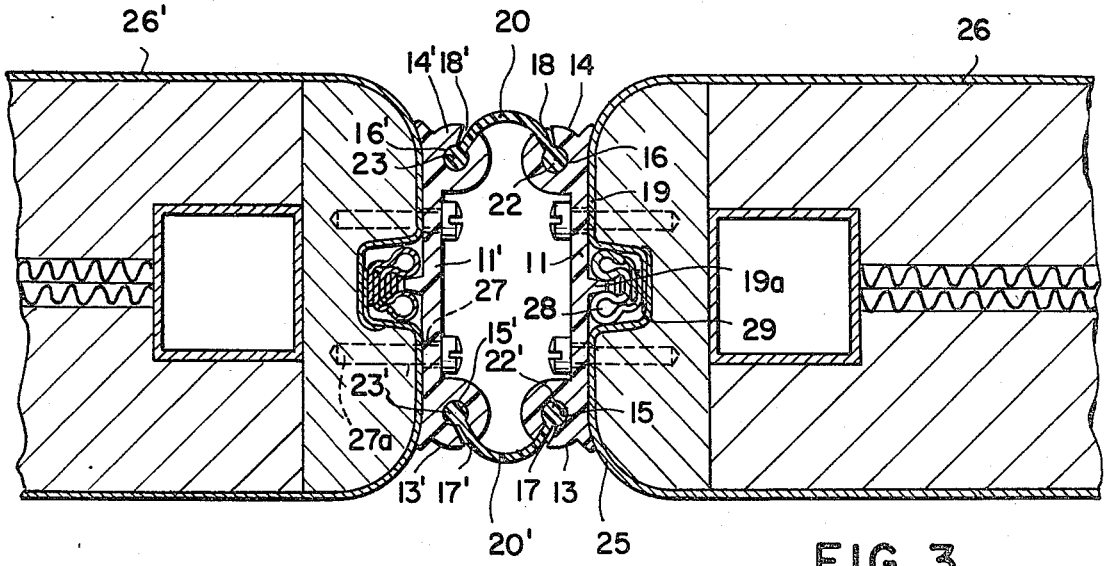
FIG.3

FIG. 4
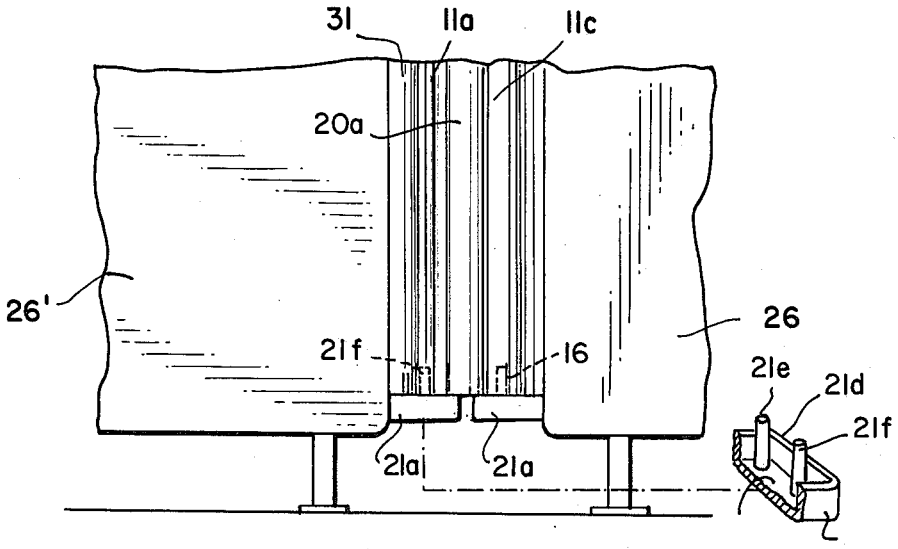
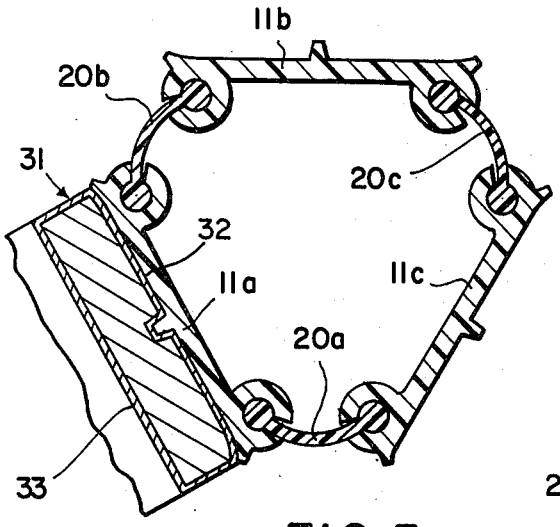
FIG. 5
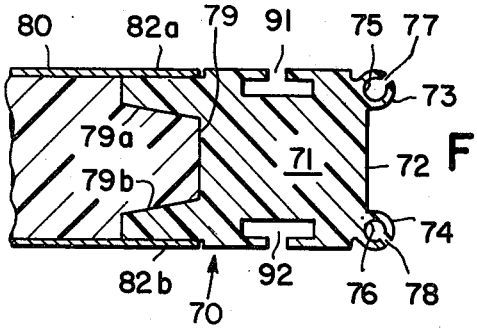
FIG. 7
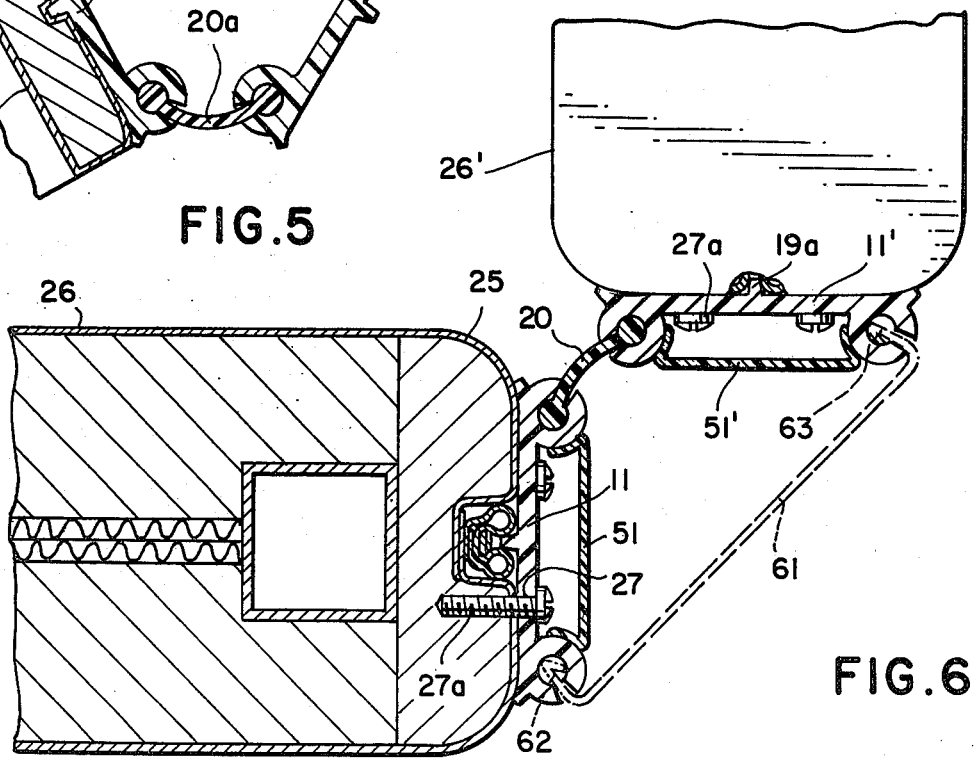
FIG. 6

OFFICE PARTITION INTERCONNECTOR ASSEMBLY

BACKGROUND OF THE INVENTION

This is a continuation of copending U.S. applications Ser. No. 935,041, filed Aug. 18, 1978, which is a continuation of Ser. No. 829,386, filed Aug. 31, 1977 which is a continuation of Ser. No. 673,492, filed Apr. 5, 1976, respectively now abandoned.

Heretofore, the joinder of panels to form office partitions was accomplished by rigid non-flexible structures which did not accommodate many desired layouts for office arrangements formed by the partitions. Tongue and groove arrangements and slotted tubular encasements gave a minimum flexibility and adaptability for the provision of offices of different shapes and sizes. The structures were quite limited and many desired types of layouts could not be accomplished. Furthermore, the rigid joinders were unattractive and costly. Only set predetermined patterns could be made which were then necessarily rigidly maintained in position. There have been no practical suggestions in the office partition or kindred arts which propose a solution to the foregoing problems.

Several years ago, there was a structure presented in U.S. Pat. No. 2,978,020 which provided a flexible connection between slats of a multiple slat-type folding door. The provision was merely such that each slat could be connected to the other in a predetermined way to accomplish the accordion-type folding of the door itself. In this construction, each slat of the door abutted the adjacent slat and movement therebetween was limited to a range measured in degrees whereby there was no flexibility for use other than for the purpose disclosed which was for a folding door. The slots to accommodate the hinge shown in this patent were provided within the slats of the door itself which was a costly and involved procedure. As a consequence, there has been no disclosure other than a direct connection between slats in a special door panel structure. There was no provision of an intermediate self-contained unit which can be interchangeably and flexibly mounted on a panel-partition arrangement to afford and provide an infinite variety of shapes and arrangements for an office or the like.

SUMMARY OF THE INVENTION

The present invention solves the foregoing problems in an efficient and economical manner. The connecting means provided forms an interconnector assembly which is completely flexible and adaptable in its ability to provide an almost infinite variety of shapes and layouts for rooms accomplished by joining office partition panels together. In accomplishing this result the connection means provides, in effect, a universal connection. The interconnector assembly comprises a substantially rigid base or support member or plate provided at or near the lateral ends thereof with outwardly projecting sleeve portions. The intermediate portion of the support plate forms a central web between the sleeves. The sleeve portions are provided with a vertical slot extending from the aperture within the sleeve to the exterior of the sleeve. This support unit is adapted to be secured to the lateral end portions of a panel used to form office partitions or it may be secured to any suitable cap member placed over the corresponding end portions of the partition panels.

In accordance with the invention, a flexible member is conjointly provided which may be of any suitable resilient or flexible material such as rubber or flexible plastic. This member comprises a flexible web whose side edges are formed into enlarged or bulbous portions extending substantially the entire length of each side of the intermediate web. The bulbous portion which may be of any suitable desired enlarged edge or bead cross-sectional shape is of a size whose outer diameter is substantially the same as the inner diameter or the sleeve portion. In turn, the sleeve aperture will have a cross-sectional shape complemental to that of the flexible web bulbous or enlarged edge or bead. Thus, a corresponding enlarged or bulbous portion at the edge of the web is accommodated within one of the apertures in the sleeve and the adjacent portion of the central flexible extent of the web disposed between the enlarged edges is accommodated within the adjacent slot formed in the sleeve member which communicates with that aperture. The supporting member is affixed to the lateral edge of one panel of an office partition. The other enlarged portion or edge of the flexible web member is similarly accommodated within the sleeve member of another support member secured to the adjacent edge of another panel of an office partition. By this means, two panels may be secured together in lateral end to lateral end adjacency with a completely flexible and adaptable connection formed by the connecting means provided as desired at each such ends of the adjacent panels. Intermediate panels may be secured together by the same device or a simple fixed connection may be used.

In the event the panels are to be secured together in co-planar or tandem relationship, it is only necessary to form the flexible web connection between both sleeves of a support member on one end of a panel with both sleeves of a corresponding support member on the end of an adjacent panel. This connection would provide for the joinder of panel members together in a straight line layout to thus form a wall portion by means of the office partition.

It will be understood, however, that a large variety of forms of partition layouts may be accomplished with the use of these flexible and adaptable connectors. For example, three such connectors may be secured together in more or less triangular form by merely connecting the sleeve of one support member to another by means of the flexible member or web in sequence in the form of a triangle using the corresponding flexible web in essence as the joinder.

The connectors may be formed into a rectangle or square, if desired, by making the same edge-to-edge connection of the corresponding sleeves of the support members through the web connections in rectangular form. Thus, in the ultimate assembly, an infinte variety of shapes may be used depending on the predetermination of the user seeking particular sizes and shapes of offices. In addition, should the shape and size of a room be required to be changed for any reason, this too can be accomplished simply be detaching the member parts from each other and reassembling them in any other desired form.

In addition, the connectors can be provided with caps at the top and bottom which have means for accommodation within the channels of the connector. The caps prevent any inadvertent movement of the web of the connector out of the channels in either an upward or downward direction.

BRIEF DESCRIPTION OF THE DRAWINGS

FIG. 1 is a perspective view of the interconnector of the present invention showing the support member and the flexible web in separated form;

FIG. 2 is a partial perspective view of the panels for an office wall partition joined together in side-by-side relationship by the interconnector of the present invention;

FIG. 3 is a view taken along the lines 3—3 of FIG. 2;

FIG. 4 is a partial side view of a set of panels with the interconnector having an optionally increased thickness and also showing an end cap for maintaining the web of the connector against movement disposed apart from the connector and in dotted lines in position at the bottom end of the connector.

FIG. 5 is a top plan view of the interconnector of the present invention assembled in triangular form with the panels of the office partitions extending outwardly therefrom;

FIG. 6 is a top view of the interconnectors of the present invention secured to panels forming office partitions disposed at right angles to each other and showing in solid lines a cover strip member disposed over the central portion of the support member, and in dotted lines an alternative adapter plate or cover for the exterior of the unit, and FIG. 7 shows a top view of a modified block form of the support member of the interconnector of the present invention.

DETAILED DESCRIPTION OF THE PRESENT INVENTION

As shown in the drawings, a new and unique interconnector for office partitions is provided by the present invention. The interconnector 10 comprises two components which when joined together form a module which, in a relatively inexpensive way, enables the erection of a substantially infinite variety of shapes and arrangements of panel partitions for offices. In essence, this module consists in a somewhat rigid vertically elongate solid unitary support member 11 which as shown in FIGS. 1–3 has a relatively thin central web or intermediate portion 12. At or near the edges of the support member 11, are outwardly extending receptive or edge retaining channel means 13 and 14 which, as shown, comprise sleeve portions or cooperating spaced apart wall means having central apertures 15 and 16. Extending from the central apertures to the outside of the sleeve portions 13 and 14 are communicating slots 17 and 18 which extend vertically along the sleeve portion or set of cooperating walls means correspondingly as illustrated. A panel engaging backing surface 19 is provided on the rear of the support member 11. Thus, support member 11 has a solid main web means, here constituted by intermediate portion 12, defining a continuous enclosing main boundary surface of selective cross-sectional profile, which is provided along its rearward continuous surface portion with partition panel engaging means via backing surface 19, and at its forward continuous surface portion with edge retaining channel means 13 and 14. Each channel means includes cooperating spaced apart wall means which independently project externally forwardly outwardly from the main boundary surface of the main web means at such forward surface portion and remotely from such rearward surface portion and terminate in corresponding substantially uniform thickness free edge portions in self-disposed relation to the remainder of the support member and which extend beyond the profile of the adjacent surface portion of the support member 11 thereat and define the open channel insert slot 17 or 18 therebetween as the case may be. The other component of the module forming the interconnector of the present invention comprises a corresponding vertically elongate flexible member or web 20 having a central or intermediate web portion 21 and two enlarged or bulbous bead type edge portions 22 and 23. Flexible web 20 is preferably substantially resiliently displaceable out of its normal plane.

To assemble the interconnector of the present invention, it is only necessary to secure the support member 11 as a separate unit via its rear or panel engaging backing surface 19 to the existing lateral side edge or cap 25 of a partition panel member 26 used to ultimately form office partitions when joined to other panel members. The securement of the support member to the panel member may be made by any one of numerous well-known arrangements and is clearly illustrated as a screw connection via support member screw accommodating aperture 27 and screw **27*a* in FIGS. 3 and 6. When the support member 11 is thus in position, the flexible member 20 is attached thereto by inserting the large bead edge portion 22 into the aperture 16 in the sleeve 14. The portion of the web 21 immediately adjacent the enlarged portion 22 is accommodated within the communicating slot 18. To connect two panels together along a straight line as shown in FIGS. 2 and 3, the other enlarged or bulbous edge 23 of the flexible member 20 is inserted into the aperture 16' within the sleeve 14' of the like support member 11' which is affixed to the next adjacent panel 26'. The portion of the web 21 which is immediately adjacent to the enlarged portion 23 is then accommodated within the slot 18' of the receptive or edge retaining channel means or sleeve 16'**.

A similar connection is made between the enlarged portion 22' of the other flexible member or web 20' and the sleeve 13, aperture 15 and slot 17 of the support member 11 on one panel 26 and for the engagement of the enlarged or bulbous portion 23' in the aperture 15' of the sleeve 13' and slot 17' of the like support member 11' on the other panel 26', as shown in FIGS. 2 and 3. Thus, the panels may be joined together with facility and dispatch in a completely flexible connecting manner. An appropriate top cap or cover (not shown) may be fitted onto the top end of the connection to close the opening thereat, for instance of a shape conforming to the top opening as shown in FIG. 3 which is bounded by parts 11, 11', 20 and 20'.

To facilitate the construction, the support members 11 and 11' may be secured to the panels before shipment or immediately upon delivery thereof whereupon the size and shape of office desired may be provided only by the inter-engagement of the flexible member 20 with the sleeves of the support members on the various panels provided for this purpose.

By the optional provision of the central locating rib **19*a*, the support member 10 may be readily located on the adjacent panel end and preferably accommodated in the optional upholstered double welt 28 disposed in the panel end groove 29**.

While the enlarged edges 22 and 23 are preferably in the form of bulbous or round bead edge cross-sectional configuration and the corresponding edge retaining channel means 15 and 16 have channel apertures of complemental bulbous cross-sectional configuration, any desired cross-sectional shape may be suitably used such as an oval, triangular, rectangular or other polygonal shape so long as the enlarged web edge in question is retained operatively in the sleeve channel means.

Also, although less preferred, hook-shaped or U-shaped or V-shaped cross sectional configurations may be provided for the enlarged edges 22 or 23, preferably with the free end portion thereof being resiliently compressible inwardly toward the remainder of such enlarged edge portion so as to close the intermediate space bounded therebetween for facilitating insertion longitudinally through the sleeve aperture 15 or 16, as the case may be, in the manner in which the preferred enlarged bulbous bead type edge portions are normally inserted, or even to enable such resiliently compressible portion to be snap fitted into the appropriate sleeve aperture directly radially inwardly via the corresponding communicating slot 17 or 18. Once inserted, the appropriate cross sectional configuration of the resultant enlarged edge portion 22 or 23 will sufficiently extend and engage the surrounding surface of the particular sleeve aperture so as to prevent disengagement thereat.

In this regard, it will be realized that although preferred, the enlarged edges of the flexible web and the sleeve apertures of the support member need not be exactly complemental in cross sectional configuration, since these parts need only removably connectingly coact to permit their operative interlocking engagement without objectionable play when the panels are interconnected thereby.

As shown in FIGS. 4 and 5, the arrangement may comprise three corresponding support members 11*a*, 11*b* and 11*c* interconnected in a more or less triangular disposition via intervening flexible webs 20*a*, 20*b*, and 20*c*, in a manner similar to the arrangement shown in FIG. 3, the difference being the inclusion of a third support member and accompanying flexible web. Of course, additional interconnector combination components may be appropriately provided by simple insertion operatively into the interconnector assembly system to provide a square or other polygonal configuration. In each instance, although not shown, the particular support member will be connected to the lateral end of a corresponding partition panel thereat similar to the arrangement shown in FIG. 3 to provide a layout in which the various panels extend radially or angularly outwardly from the central common connecting point.

An optional feature of increasing or adjusting the distance between a particular support member and the lateral end of the corresponding partition panel comprises the insertion therebetween of a separate selectively dimensioned or distancing intervening abutment spacer or block 31 having an appropriate backing surface engaging side 32 and partition panel engaging side 33. As shown in FIG. 5, backing surface engaging side 32 of appropriate conforming shape is connected to the backing surface of the appropriate support member 11*a* and partition panel engaging side 33 is mountable on the lateral end of the adjacent partition panel. The latter arrangement is shown more clearly in FIG. 4 where the abutment spacer 31 is interposed operatively between support member 11*a* and partition panel 26′. The same relationship would exist regarding the end to end tandem disposition of the panels shown in FIG. 3, i.e. when an intervening abutment spacer 31 is inserted at the interconnector thereat.

As also shown in FIG. 4, a cap 21*a* is locatable at the bottom and top of the interconnector. As illustrated, the cap 21*a* is disposed at the bottom of the connector. However, it will be understood that a similar cap can be located at the top of the connector. The cap 21*a* comprises a flat plate 21*b* and sidewalls 21*c*. A front wall 21*d* is also provided to cover the upper portion or lower portion of the connector. Two prongs 21*e* and 21*f* are carried by the plate 21*b* and are insertable in the channels 15 and 16 of the connector where they are frequently maintained in position. This structure prevents the web 20*a* of the connector from riding downwardly and out of its connecting position once the parts are assembled. A similar cap at the top prevents any movement of the web 20*a* in an upward direction which movement might cause the web to become dislocated.

In FIG. 6, a further feature of the invention is shown with respect to the covering of the central web portion of the support member such as when appropriate screws 27*a*, such as self-tapping screws, are inserted through screw accommodating apertures 27 for mounting the appropriate support member onto the end cap or lateral end portion 25 of the corresponding partition panel 26. In this regard, the central cover strip 51, preferably of rigid plastic material and containing bilateral end prongs or flanges, of conforming arcuate shape, may be removably snap fitted or friction fitted in overlying relation between the corresponding sleeve portions of the support member so as to be disposed in substantially raised flush relation therewith medially of the corresponding outwardly directed connecting slots in the sleeve apertures. Where a pair of partition panels 26 and 27′ is maintained in angular disposition with respect to each other, the cover arrangement shown in FIG. 6 is desirable, the additional partition panel 26′ similarly being provided with a central cover strip 51′ in removable disposition in engagement with the sleeve portions of the support member 11′ thereat. This will provide an attractive finished design for the interconnector combination.

Of course, a single common flexible web 20 is used in the FIG. 6 arrangement to complete the selective angular panel interconnector combination desired in contrast to the pair of flexible webs used in the FIG. 3 arrangement to provide a tandem panel interconnector combination and the plurality of flexible webs used in the FIG. 5 arrangement to provide a selective corresponding plurality radial panel interconnector combination.

As a further feature of the invention, in place of the central cover strips 51 and 51′, a substantially offset bilateral angular adapter plate or cover 61, shown in phantom in FIG. 6, may be utilized. In this regard, adapter plate 61 is provided with a pair of opposed retention edges 62 and 63 at the corresponding sides thereof each of which is appropriate operatively inserted in the corresponding unused sleeve aperture of the support members 11 and 11′ as shown. Such retention edges 62 and 63 may be of similar construction and cross sectional configuration to the enlarged edges 22 and 23 of the flexible web 20, but preferably will be in the form of a V-shaped end configuration or flange permitting simple longitudinal insertion into the corresponding sleeve aperture, or even snap fit insertion directly radially inwardly thereinto via the communicating slot therealong.

In this arrangement, the adapter plate 61 will cover over the exposed portions of and complete the interconnector combination to provide an alternative attractive finished design. It will be seen that the intermediate breadth between the edges 62 and 63 of adapter plate 61 is selectively larger than the corresponding intermediate breadth between the enlarged edges of flexible web 20 as shown in FIG. 6 in dependence upon the selective offset angular planar disposition of partition panels 26 and 26'.

FIG. 7 shows an alternate embodiment of the invention in providing the support member in the form of an extension end cap block 70 suitably accommodated on the lateral end portion of the partition panel 80. Specifically, block support member portion 71 is provided in similar manner to the construction shown in FIGS. 1 to 3 with intermediate portion 72 and outwardly extending edge retaining channel means 73 and 74 comprising the sleeve portions and containing central apertures 75 and 76, in turn provided with outwardly extending communicating slots 77 and 78. The panel engaging means of the support member block 70 includes backing surface 79 for operatively engaging the lateral end portion 81 of partition panel 80, with the support member block being additionally provided with bilateral locating means or ribs **79*a* and 79*b* for locating backing surface 79 on the lateral end portion 81 of such panel. Appropriately, panel 80 is correspondingly provided with end extensions 82*a* and 82*b* for overlapping disposition with locating ribs 79*a* and 79*b*** to complete the interconnecting mounting of the arrangement.

An optional further feature of the invention comprises the inclusion of external auxiliary attachment means 91 and 92 intermediately on the external side walls of the block between the sleeve portions and the backing surface for removably attaching auxiliary elements thereat such as hanging brackets, or other appropriate modules or units, or the like. The auxiliary attachment means 91 and 92 may take the form of vertical T-shaped slots of the conventional type. The embodiment of FIG. 7 lends itself to attachment of the support member block 70 onto the appropriate partition panel 80 by adhesive bonding between backing surface 79 and the lateral end 81 of the partition panel.

It will be appreciated that in accordance with one broad feature of the invention, the office partition interconnector assembly comprises a support member having partition panel engaging means for fixedly mounting the support member on a partition panel as well as edge retaining channel means projecting outwardly from the support member, together with a flexible web having an enlarged edge at one side thereof for operative insertion in the edge retaining channel means of the support member and attachment means at the other side thereof for attaching the web to another partition panel thereby to provide an interposed connection between the panels to form an office partition.

In accordance with a further broad feature of the invention, the office partition interconnector assembly comprises an office partition panel, e.g. of the conventional unmodified type, and separate therefrom an independent support member having partition panel engaging means fixedly mounting the support member on the partition panel as well as the edge retaining channel means, together with such a flexible web.

Appropriately, of course, the particular interconnector construction will be bilateral so that another edge retaining channel means or sleeve will be provided on the support member for receiving a corresponding enlarged edge of another flexible web operatively inserted thereinto for attachment of another partition panel thereat.

The support member is preferably formed of substantially rigid plastic material and the flexible web is preferably formed of resiliently flexible material permitting displacement of such web out of this normal plane, such parts being suitably provided as extruded elements. Advantageously, the alternate modifications shown in FIGS. 4, 5 and 7 permit adjustments of the dimensions of the arrangement by the inclusion of an appropriate selectively dimensioned separate intervening abutment spacer or extension end cap block construction, while the alternate cover strip and angular adaptor plate features shown in FIG. 6 permit attractive completion and covering of associated parts to provide an attractive finished arrangement. The support member, flexible web, cover strip and angular adaptor plate, as well as the abutment spacer and extension end cap block support member form, are all preferably vertically elongate parts readily provided as extruded elements of suitable plastic material.

Thus, the arrangement of FIG. 3 provides an end to end or tandem coplanar disposition of interconnected panels while that in FIG. 5 provides a plurality of such panels in radially disposed adjacency about a corresponding center point defined by the appropriate interconnector combination thereat, where as the embodiment of FIG. 6 permits selective offset angular planar disposition of such panels with respect to each other, thereby making possible an infinite variety of layouts for office partitions in practice. Advantageously, such arrangements are readily assembled, and even disassembled in the case where changes in office layouts are desired, all with a minimum of effort while employing inexpensive and durable parts or modules of simple and practical interchangeable design. Indeed, such parts of the interconnector assembly of the invention may be appropriately utilized with suitable existing partition panels generally without the need for modifying such panels to accommodate the desired interconnection.

While the foregoing specification and drawings have been set forth to illustrate without limitation the concept of the present invention, it will be realized that various changes and modifications may be made therein without departing from the spirit and scope of the present invention which is to be limited solely by the scope of the appended claims.

What is claimed is:

1. Office partition interconnector assembly comprising a solid unitary support member having a main web means defining a continuous enclosing main boundary surface of selective cross-sectional profile provided along one surface portion thereof constituted as a rearward continuous surface portion with partition panel engaging means for fixedly mounting the support member on one partition panel and provided at another surface portion thereof constituted as a forward continuous surface portion with selectively positioned edge retaining external channel means including a pair of cooperating spaced apart individual wall means each independently projecting externally forwardly outwardly from the main boundary surface of the main web means at such forward surface portion and remotely from such rearward surface portion and terminating in corresponding substantially uniform thickness free edge portions in self disposed relation to the remainder of such support member and extending beyond the profile of the adjacent surface portion of the support member thereat and defining an open channel insert slot therebetween, and a flexible web having an enlarged edge at one side thereof in continuous integral coextensive relation therewith for operative insertion between the cooperating wall means of the edge retaining channel means of the support member and attachment means at the other side thereof for attaching the web to another partition panel thereby to provide an interposed connection between such panels to form an office partition.

2. Assembly according to claim 1 wherein another edge retaining channel means is provided on the support member for receiving a corresponding enlarged edge of another flexible web operatively inserted therein for attachment of another such partition panel thereat.

3. Assembly according to claim 1 wherein the enlarged edge of the flexible web is of bulbous bead edge cross-sectional configuration and the edge retaining channel means has a channel aperture of complemental bulbous cross-sectional configuration.

4. Assembly according to claim 1 wherein the support member is substantially rigid and the flexible web is resiliently displaceable out of its normal plane.

5. Assembly according to claim 1 wherein the partition panel engaging means includes a backing surface for operatively engaging a lateral end of the adjacent partition panel.

6. Assembly according to claim 1 wherein the partition panel engaging means includes a backing surface, and a separate intervening abutment spacer is provided having a backing surface engaging side and a partition panel engaging side, the abutment spacer being connected at the backing surface engaging side thereof to the backing surface and being mountable at the partition panel engaging side thereof on the lateral end of the adjacent partition panel.

7. Assembly according to claim 1 wherein the support member is in the form of a block and the partition panel engaging means includes a backing surface for operatively engaging a lateral end of the adjacent partition panel and containing locating means for locating the backing surface on such lateral end of the adjacent partition panel.

8. Assembly according to claim 7 wherein the block is an extension end cap block intermediately provided with external auxiliary attachment means for removably attaching auxiliary means thereat.

9. Assembly according to claim 1 wherein the support member is in the form of a bilateral support member provided with a pair of spaced apart edge retaining channel means projecting outwardly and each correspondingly containing an outwardly directed communicating slot, and the flexible web is in the form of a bilateral flexible web provided with a pair of opposed enlarged edges one of which is operatively inserted in one of the edge retaining channel means and the other of which is operatively insertable in one corresponding edge retaining channel means of another such support member on such other partition panel for attaching the flexible web to such other partition panel thereby to provide an interposed connection between such panels to form an office partition.

10. Assembly according to claim 9 wherein a central cover strip is removably disposed in overlying relation between the outwardly projecting edge retaining channel means and in substantially raised flush relation therewith medially of the corresponding outwardly directed communicating slots.

11. Assembly according to claim 10 wherein screw accommodating attachment means are provided in the support member intermediate the outwardly projecting edge retaining channel means and in underlying relation beneath the central cover strip for attaching the support member to the adjacent partition panel.

12. Assembly according to claim 9 wherein the partition panel engaging means includes a backing surface for operatively engaging a lateral end of the adjacent partition panel and containing locating means for locating the backing surface on such lateral end of the adjacent partition panel.

13. Assembly according to claim 9 wherein a selectively offset bilateral angular adapter plate is provided having a pair of opposed retention edges at the corresponding sides thereof one of which is operatively inserted in the other edge retaining channel means of the support member and the other of which is operatively insertable in the other corresponding edge retaining channel means of such other support member on such other partition panel when the partition panels are disposed at a selectively offset angular planar disposition with respect to each other.

14. Assembly according to claim 13 wherein the intermediate breadth between the opposed retention edges of the adapter plate is larger than the corresponding intermediate breadth between the opposed enlarged edges of the flexible web.

15. Office partition interconnector assembly according to claim 1 comprising a vertically elongate and substantially rigid bilateral support member having partition panel engaging means which includes a backing surface for operatively engaging a lateral end of one partition panel for fixedly mounting the support member on such partition panel, and further having a pair of spaced apart edge retaining channel means projecting outwardly from the support member and each correspondingly containing an outwardly directed communicating slot, and a vertically elongate flexible web substantially resiliently displaceable out of its normal plane and having a pair of opposed enlarged edges at the sides thereof one of which is operatively inserted in one of the edge retaining channel means through the corresponding communicating slot and the other of which is operatively insertable in one corresponding edge retaining channel means of another such support member on another partition panel for attaching the flexible web to such other partition panel thereby to provide an interposed connection between such panels to form an office partition.

16. Assembly according to claim 15 wherein the enlarged edges of the flexible web are of substantially bulbous bead edge cross-sectional configuration and the edge retaining channel means each has a channel aperture of complemental bulbous cross-sectional configuration.

17. Assembly according to claim 15 wherein a separate intervening abutment spacer is provided having a backing surface engaging side and a partition panel engaging side, the abutment spacer being connected at the backing surface engaging side thereof to the backing surface of the partition panel engaging means of the support member and being mountable at the partition panel engaging side thereof on the lateral end of the adjacent partition panel.

18. Assembly according to claim 15 wherein the support member is in the form of a vertically elongate solid block and the backing surface of the partition panel engaging means contains locating means for locating the backing surface on such lateral end of the adjacent partition panel.

19. Assembly according to claim 15 wherein a vertically elongate central cover strip is removably disposed in snap fit overlying relation between the outwardly projecting edge retaining channel means and in substantially raised flush relation therewith medially of the corresponding outwardly directed communicating slots.

20. Assembly according to claim 19 wherein screw accommodating attachment aperture means are provided in the support member intermediate the outwardly projecting edge retaining channel means and in underlying relation beneath the central cover strip for attaching the support member to the adjacent partition panel.

21. Assembly according to claim 15 wherein the backing surface of the partition engaging means contains vertically elongate rib locating means for locating the backing surface on such lateral end of the adjacent partition panel.

22. Assembly according to claim 15 wherein a vertically elongate selectively offset bilateral angular adapter plate is provided having a pair of opposed retention edges at the corresponding sides thereof one of which is operatively inserted in the other of the edge retaining channel means of the support member and the other of which is operatively insertable in the other corresponding edge retaining channel means of such other support member on such other partition panel when the partition panels are disposed at a selectively offset angular planar disposition with respect to each other, the intermediate breadth between the opposed retention edges of the adapter plate being selectively larger than the corresponding intermediate breadth between the opposed enlarged edges of the flexible web in dependence upon the offset planar disposition of the partition panels.

23. Office partition interconnector assembly according to claim 1 comprising two office partition panels, two vertically elongate and substantially rigid bilateral support members, end having partition panel engaging means which includes a backing surface operatively engaging a lateral end of a corresponding one of the partition panels and fixedly mounting the particular support member thereon, and each further having a pair of spaced apart edge retaining channel means projecting outwardly from the support member with the edge retaining channel means each correspondingly containing an outwardly directed communicating slot, and two vertically elongate flexible webs, each substantially resiliently displaceable out of its normal plane and having a pair of opposed enlarged edges at the sides thereof, one of the enlarged edges of one of the flexible webs being operatively inserted in one of the edge retaining channel means through the corresponding communicating slot of one of the support members and the other of such enlarged edges being inserted in one of the edge retaining channel means through the corresponding communicating slot of the other of the support members, and one of the enlarged edges of the other of the flexible webs being operatively inserted in the other of the edge retaining channel means through the corresponding communicating slot of such one of the support members and the other of such enlarged edges being inserted in the other of the edge retaining channel means through the corresponding communicating slot of the other of the support members thereby to provide an interposed connection between such panels to form an office partition.

24. Office partition interconnector assembly according to claim 1 comprising a plurality of at least three office partition panels in radially disposed adjacency about a common center point, a corresponding plurality of at least three vertically elongate and substantially rigid bilateral support members, each having partition panel engaging means which includes a backing surface operatively engaging the radially inward adjacent lateral end of a corresponding one of the partition panels and fixedly mounting the particular support member thereon, and each further having a pair of spaced apart edge retaining channel means projecting outwardly from the support member with the edge retaining channel means each correspondingly containing an outwardly directed communicating slot, and a corresponding plurality of at least three vertically elongate flexible webs, each substantially resiliently displaceable out of its normal plane and having a pair of opposed enlarged edges at the sides thereof, the enlarged edges of each of the flexible webs being operatively inserted in the radially adjacent edge retaining channel means through the corresponding communicating slots of corresponding radially adjacent support members on correspondingly radially adjacent partition panels thereby to provide an interposed common connection among such panels to form an office partition.

25. Office partition interconnector assembly comprising an office partition panel, a separate and independent solid unitary support member having a solid main web means defining a continuous enclosing main boundary surface of selective cross-sectional profile provided along one surface portion thereof constituted as a rearward continuous surface portion with partition panel engaging means fixedly mounting the support member on the partition panel and provided at another surface portion thereof constituted as a forward continuous surface portion with selectively positioned edge retaining external channel means including a pair of cooperating spaced apart individual walls means each independently projecting externally forwardly outwardly from the main boundary surface of the main web means at such forward surface portion and remotely from such rearward surface portion and terminating in corresponding substantially uniform thickness free edge portions in self-disposed relation to the remainder of such support member and independently extending externally forwardly outwardly beyond the profile of the adjacent surface portion of the support member thereat and defining an open channel insert slot therebetween, and a flexible web having an enlarged edge at one side thereof in continuous integral coextensive relation therewith for operative insertion between the cooperating wall means of the edge receiving channel means of the support member and attachment means at the other side thereof for attaching the web to another partition panel thereby to provide an interposed connection between such panels to form an office partition.

26. Assembly according to claim 25 wherein another edge retaining channel means is provided on the support member for receiving a corresponding enlarged edge of another flexible web operatively inserted therein for attachment of another such partition panel thereat.

27. Assembly according to claim 25 wherein the enlarged edge of the flexible web is of bulbous bead edge cross-sectional configuration and the edge retaining channel means has a channel aperture of complemental bulbous cross-sectional configuration.

28. Assembly according to claim 25 wherein the support member is substantially rigid and the flexible web is resiliently displaceable out of its normal plane.

29. Assembly according to claim 25 wherein the partition panel engaging means includes a backing surface for operatively engaging a lateral end of the adjacent partition panel.

30. Assembly according to claim 25 wherein the partition panel engaging means includes a backing surface, and a separate intervening abutment spacer is provided having a backing surface engaging side and a partition panel engaging side, the abutment spacer being connected at the backing surface engaging side thereof to the backing surface and being mounted at the partition engaging side thereof on the lateral end of the partition panel.

31. Assembly according to claim 25 wherein the support member is in the form of a block and the partition panel engaging means includes a backing surface operatively engaging the lateral end of the partition panel and containing locating means for locating the backing surface on such lateral end of the partition panel.

32. Assembly according to claim 31 wherein the block is an extension end cap block intermediately provided with external auxiliary attachment means for removably attaching auxiliary means thereat.

33. Assembly according to claim 25 wherein the support member is in the form of a bilateral support member provided with a pair of spaced apart edge retaining channel means each correspondingly containing an outwardly directed communicating slot, and the flexible web is in the form of a bilateral flexible web provided with a pair of opposed enlarged edges one of which is operatively inserted in one of the edge retaining channel means and the other of which is operatively insertable in one corresponding edge retaining channel means of another such support member on such other partition panel for attaching the flexible web to such other partition panel thereby to provide an interposed connection between such panels to form an office partition.

34. Office partition interconnector assembly according to claim 25 comprising two office partition panels disposed at a selectively offset angular planar disposition with respect to each other, two vertically elongate and substantially rigid bilateral support members, each having partition panel engaging means fixedly mounting the particular support member on the lateral end of a corresponding one of the partition panels, and each further having a pair of spaced apart edge retaining channel means with the edge retaining channel means each correspondingly containing an outwardly directed communicating slot, a vertically elongate flexible web substantially resiliently displaceable out of its normal plane and having a pair of opposed enlarged edges at the sides thereof one of which is operatively inserted in one of the edge retaining channel means through the corresponding communicating slot of one of the support members and the other of which is inserted in one of the edge retaining channel means through the corresponding communicating slot of the other of the support members, and a vertically elongate selectively offset bilateral angular adapter plate having a pair of opposed retention edges at the corresponding sides thereof one of which is operatively inserted in the other edge retaining channel means through the corresponding communicating slot of such one of the support members and the other of which is operatively inserted in the other of the edge retaining channel means through the corresponding slot of the other of the support members, the intermediate breadth between the opposed retention edges of the adapter plate being selectively larger than the corresponding intermediate breadth between the opposed enlarged edges of the flexible web in dependence upon the offset angular planar disposition of the partition panels, thereby to provide an interposed angular connection between such panels to form an office partition.

35. Office partition interconnector assembly according to claim 25 comprising two office partition panels, two vertically elongate and substantially rigid bilateral support members, each having partition panel engaging means fixedly mounting the particular support member on the lateral end of a corresponding one of the partition panels, and each further having a pair of spaced apart edge retaining channel means with the edge retaining channel means each correspondingly containing an outwardly directed communicating slot, and two vertically elongate flexible webs, each substantially resiliently displaceable out of its normal plane and having a pair of opposed enlarged edges at the sides thereof, one of the enlarged edges of one of the flexible webs being operatively inserted in one of the edge retaining channel means through the corresponding communicating slot of one of the support members and the other of such enlarged edges being inserted in one of the edge retaining channel means through the corresponding communicating slot of the other of the support members, and one of the enlarged edges of the other of the flexible webs being operatively inserted in the other of the edge retaining channel means through the corresponding communicating slot of such one of the support members and the other of such enlarged edges being inserted in the other of the edge retaining channel means through the corresponding communicating slot of the other of the support members thereby to provide an interposed connection between such panels to form an office partition.

36. Office partition interconnector assembly according to claim 25 comprising a plurality of at least three office partition panels in radially disposed adjacency about a common center point, a corresponding plurality of at least three vertically elongate and substantially rigid bilateral support members, each having partition panel engaging means fixedly mounting the particular support member on the radially inward adjacent lateral end of a corresponding one of the partition panels, and each further having a pair of spaced apart edge retaining channel means with the edge retaining channel means each correspondingly containing an outwardly directed communicating slot, and a corresponding plurality of at least three vertically elongate flexible webs, each substantially resiliently displaceable out of its normal plane and having a pair of opposed enlarged edges at the sides thereof, the enlarged edges of each of the flexible webs being operatively inserted in the radially adjacent edge retaining channel means through the corresponding communicating slots of corresponding radially adjacent support members on correspondingly radially adjacent partition panels thereby to provide an interposed common connection among such panels to form an office partition.

37. Office partition interconnector assembly comprising a solid unitary support member having a main web means defining a continuous enclosing main boundary surface of selective cross-sectional profile provided along one surface portion thereof constituted as a rearward continuous surface portion with partition panel engaging means for fixedly mounting the support member on one partition panel and provided at another surface portion thereof constituted as a forward continuous surface portion with selectively positioned edge retaining external channel means including a pair of cooperating spaced apart individual wall means each independently projecting externally forwardly outwardly from the main boundary surface of the main web means at such forward surface portion and remotely from such rearward surface portion and terminating in corresponding substantially uniform thickness free edge portions in self-disposed relation to the remainder of such support member and independently extending externally forwardly outwardly beyond the perimetric profile of the adjacent surface portion of the support member thereat and defining an open channel insert slot therebetween, a flexible web having an enlarged edge at one side thereof in continuous integral coextensive relation therewith for operative insertion between the cooperating wall means of the edge retaining channel means of the support member and attachment means at the other side thereof for attaching the web to another partition panel thereby to provide an interposed connection between such panels to form an office partition, and a cap in an end of said support member provided with means engageable within said channel retaining means for maintaining the flexible web in position against vertical movement in the edge retaining channel means.

38. Office partition interconnector assembly comprising an office panel, a separate and independent solid unitary support member having a main web means defining a continuous enclosing main boundary surface of selective cross-sectional profile provided along one surface portion thereof constituted as a rearward continuous surface portion with partition panel engaging means fixedly mounting the support member on the partition panel and provided at another surface portion thereof constituted as a forward continuous surface portion with selectively positioned edge retaining external channel sleeve means including a pair of cooperating spaced apart correspondingly oppositely curved individual wall means each independently projecting externally forwardly outwardly from the main boundary surface of the main web means at such forward surface portion and remotely from such rearward surface portion and terminating in corresponding substantially uniform thickness free edge portions in self-disposed relation to the remainder of such support member and independently extending externally forwardly outwardly beyond the perimetric profile of the adjacent surface portion of the support member thereat and defining a correspondingly rounded open channel insert slot therebetween, a flexible web having an enlarged correspondingly complementally rounded edge at one side thereof in continuous integral coextensive relation therewith for operative insertion between the cooperating wall means of the edge receiving channel sleeve means of the support member and attachment means at the other side thereof for attaching the web to another partition panel thereby to provide an interposed connection between such panels to form an office partition, and a cap at the end of the support member provided with means disposed within said edge receiving channel sleeve means to prevent vertical movement of said flexible web.

* * * * *